US011549262B1

(12) United States Patent
Zournas et al.

(10) Patent No.: US 11,549,262 B1
(45) Date of Patent: Jan. 10, 2023

(54) HEAVY CYCLE GRATING SYSTEM

(71) Applicant: Ohio Gratings, Inc., Canton, OH (US)

(72) Inventors: Aristotelis Zournas, Orrville, OH (US); Michael D. Russo, Minerva, OH (US); Kenneth P. Apperson, Oneonta, AL (US)

(73) Assignee: Ohio Gratings, Inc., Canton, OH (US)

( * ) Notice: Subject to any disclaimer, the term of this patent is extended or adjusted under 35 U.S.C. 154(b) by 83 days.

(21) Appl. No.: 17/358,145

(22) Filed: Jun. 25, 2021

(51) Int. Cl.
*E04C 2/42* (2006.01)

(52) U.S. Cl.
CPC ..... *E04C 2/423* (2013.01)

(58) Field of Classification Search
CPC ..... E04C 2/423; E04C 2/422; E01D 19/125; E01D 2101/30; E01C 9/10
See application file for complete search history.

(56) References Cited

U.S. PATENT DOCUMENTS 2,128,753 A * 8/1938 Lienhard ..... E04C 2/425 52/667
2,645,985 A * 7/1953 Beebe ..... E04C 2/425 52/669
2,834,267 A * 5/1958 Beebe ..... E04C 2/425 52/667
5,642,549 A * 7/1997 Mangone ..... E04C 2/425 404/70
5,806,121 A * 9/1998 Mangone ..... E04C 2/425 404/70
6,018,833 A * 2/2000 Imm ..... E01D 19/125 404/70
6,049,932 A * 4/2000 Mangone ..... E04C 2/425 404/70
7,832,172 B2 * 11/2010 Bartley, II ..... E04C 2/423 52/669
8,122,674 B2 * 2/2012 Bartley ..... E04C 2/425 52/177
2011/0083395 A1 * 4/2011 Bartley, II ..... E04C 2/423 52/664

* cited by examiner

*Primary Examiner* — Patrick J Maestri
(74) *Attorney, Agent, or Firm* — Sand, Sebolt & Wernow Co., LPA

(57) ABSTRACT

A heavy cycle grating system incorporating a plurality of toothed support members to support a plurality of grate slats while securing them within grating assembly. This configuration allows the present grating system to accommodate higher volume of heavy use, such as found with vehicular applications. Further provided is a grating assembly configured for longer life and improved damage and wear-resistance while simultaneously reducing noise generated during use thereof.

20 Claims, 10 Drawing Sheets

HEAVY CYCLE GRATING SYSTEM

TECHNICAL FIELD

The present disclosure relates generally to grates and grating systems. More particularly, in one example, the present disclosure relates to a grating assembly which may accommodate vehicle traffic and pedestrian traffic. Specifically, in another example, the present disclosure relates to a heavy cycle grating system which may accommodate higher volume vehicle and pedestrian traffic and/or may accommodate usage by larger and heavier vehicles.

BACKGROUND

Background Information

Grating assemblies configured for supporting vehicle and/or pedestrian traffic are commonly used on sidewalks and road surfaces requiring venting and/or drainage therethrough. Often these grating systems are configured to permit various sizing of wheels and/or foot traffic to pass thereover without catching or presenting a hazard thereto. Typically, as such grating assemblies are installed in areas where they are easily seen and not easily concealed, they are typically designed to be functional while also being aesthetically pleasing.

One such grating assembly is shown and described in U.S. Pat. No. 8,122,674, which is commonly owned and incorporated herein by reference. The grating system disclosed therein is commonly employed on a sidewalk and in areas of high volume pedestrian traffic; however, when such grating systems are employed in heavier duty applications such as on roadways and the like, over time, road debris can become wedged between the grates and may eventually cause damage and/or structural failure thereof. Further, when installed in roadways, street cleaning and/or snow removal equipment, as commonly used in colder environments, can often cause damage to similar grating systems.

SUMMARY

The present disclosure addresses these and other issues by providing a heavy cycle grating system incorporating a plurality of toothed support members to support a plurality of grate slats while securing them within grating assembly. This configuration allows the present grating system to accommodate higher volume of heavy use, such as found with vehicular applications. Further provided is a grating assembly configured for longer life and improved damage and wear-resistance while simultaneously reducing noise generated during use thereof.

In one aspect, the present disclosure may provide a grating system comprising: a pair of end plates spaced longitudinally; a first support plate operably connected to the pair of end plates and oriented perpendicularly thereto; a second support plate spaced laterally from the first end plate, the second support plate operably connected to the pair of end plates and oriented perpendicularly thereto; at least one cross member having a plurality of alternating teeth and cavities on a top edge thereof, the at least one cross member extending between the first and second support plates; at least one cross member lock bar corresponding to the at least one cross member; a plurality of slats extending between the pair of end plates, with each slat of the plurality of slats contained within a cavity of the plurality of cavities; and at least one slat lock bar operable to secure the plurality of slats in the plurality of cavities.

In another aspect, the present disclosure may provide a method of assembling a grating system comprising: securing a first support plate to a first end of a pair of end plates; securing a second support plate to a second end of the pair of end plates; sliding a cross member into a first position wherein the cross member extends through a slot defined in the first support plate and into a slot defined in the second support plate; raising the cross member into a second position wherein a top edge thereof abuts a top edge of the slots defined in each of the first and second support plates; sliding a cross member lock bar through the slots defined in each of the first and second support plates; raising the cross member lock bar to abut a bottom edge of the cross member; fixing the cross member and cross member lock bar in the second position; inserting a plurality of longitudinally extending slats into a plurality of cavities defined between a plurality of teeth extending from the top edge of the cross member; and securing the plurality of slats in position with a slat lock bar.

In yet another aspect, the present disclosure may provide a grating system comprising: a pair of end plates spaced longitudinally; a first support plate having at least one vertical slot defined therethrough, the first support plate operably connected to the pair of end plates and oriented perpendicularly thereto; a second support plate having at least one vertical slot defined therethrough, the second support plate spaced laterally from the first end plate, the second support plate operably connected to the pair of end plates and oriented perpendicularly thereto; at least one additional support plate having at least one vertical slot defined therethrough, the at least one additional support plate operably connected to the pair of end plates laterally between the first and second support plates and oriented perpendicularly thereto; at least one cross member having a plurality of alternating teeth and cavities on a top edge thereof, the at least one cross member extending between the first and second support plates and through the at least one vertical slot defined through each of the first, second, and at least one additional support plates; at least one cross member lock bar corresponding to the at least one cross member, the at least one cross bar extending between the first and second support plates and through the at least one vertical slot defined through each of the first, second, and at least one additional support plates; a plurality of slats having at least one aperture defined through each slat corresponding to and aligned with at least one aperture defined through each of the first, second, and at least one additional support plates, the plurality of slats extending between the pair of end plates, with each slat of the plurality of slats contained within a cavity of the plurality of cavities; and at least one slat lock bar slidably engaged with the at least one aperture defined through each slat of the plurality of slats and the at least one aperture defined through the first, second, and the at least one additional support plates, the at least one slat lock bar operable to secure the plurality of slats in the plurality of cavities.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
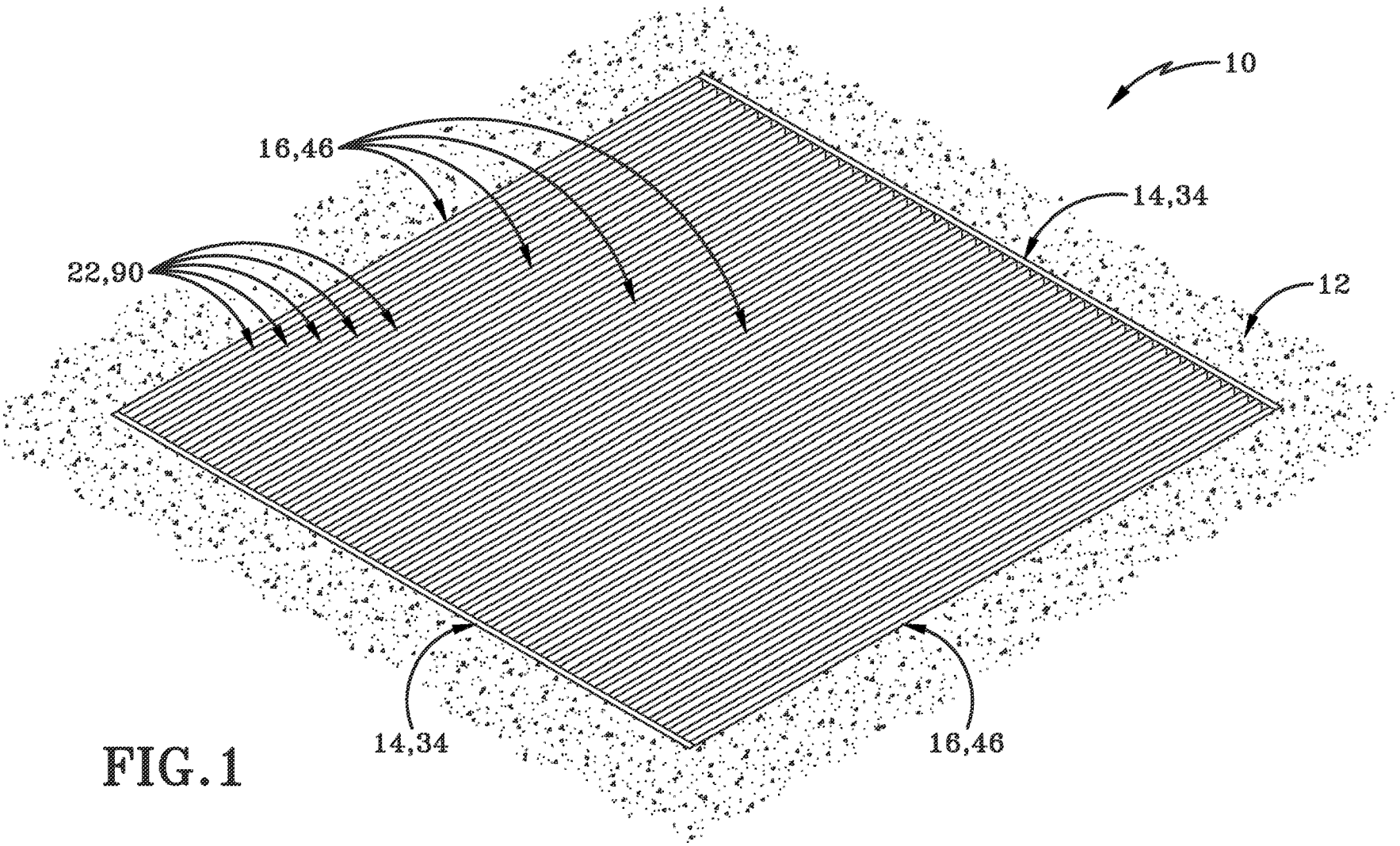
FIG. 1 is a top isometric view of a grating system according to one aspect of the present disclosure.
Figure 2:
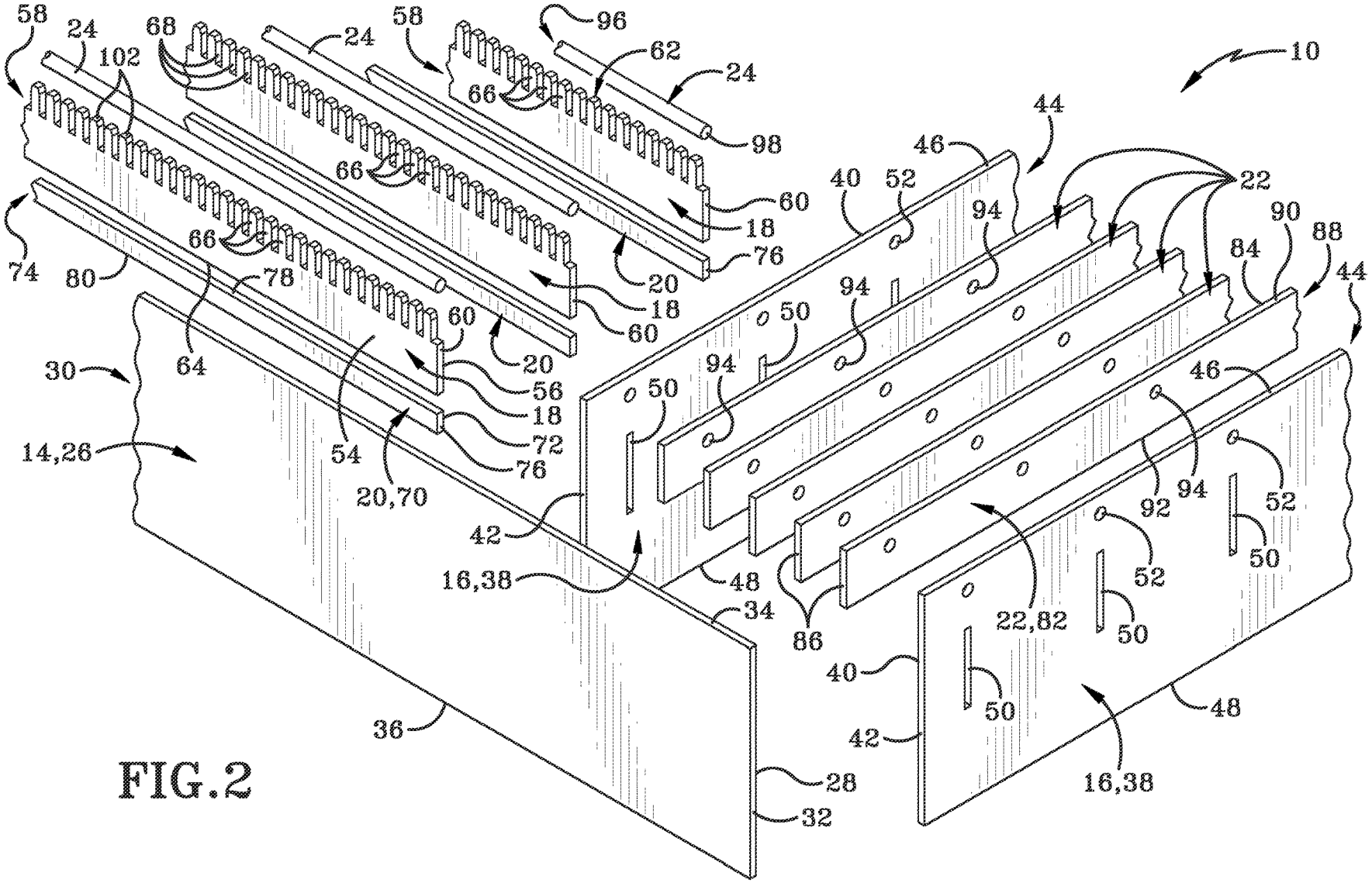
FIG. 2 is a top isometric exploded view of a grating system according to one aspect of the present disclosure.

With reference to FIGS. 1 and 2, a grating assembly of the present disclosure is shown and generally indicated as grating system 10. Grating system 10 is contemplated to be installed on or within a supporting structure 12 and may further include a pair of end plates 14, at least one support plate 16, at least one toothed cross member 18, at least one cross member lock bar 20, a plurality of slats 22, and at least one slat lock bar 24.

Supporting structure 12, as shown and discussed herein, is contemplated as a substantially planar structure such as a concrete sidewalk, roadway or the like. It will be understood; however, that supporting structure 12 may include any suitable structure and/or support system such as metal beams or the like, as may be found in bridges, elevated walkways, platforms or similar applications. Further it will be understood that grating system 10 may be sized and/or configured for installation in supporting structures 12 of varying materials and/or having varying profiles as dictated by the desired implementation. Accordingly, as described herein, use in relation to a sidewalk and/or roadway will be understood as an exemplary use and installation of grating system 10 and not a limiting example thereof. Supporting structure 12 is contemplated to have a surface, for example, a walking surface of a sidewalk or a road surface, that is substantially planar and coincides with a plane defined by the top of grating system 10, as discussed herein, to maintain a generally even and flat transition between supporting structure 12 and grating system 10. This may facilitate installation without having portions of grating system 10 extending above or below the surface of supporting structure 12 to eliminate potential hazards or dangers to users, user vehicles, and/or to grating system 10 and supporting structure 12.

End plates 14 may have a first side 26 opposite a second side 28 and defining the longitudinal thickness of end plates 14 therebetween. End plates 14 may have a first end 30 spaced apart from a second end 32 and defining a lateral or transverse direction therebetween and a top edge 34 spaced apart from a bottom edge 36 and defining a vertical direction therebetween. End plates 14 may extend laterally in that they may be oriented perpendicular to supports plates 16 and slats 22. Accordingly, it will be understood that the lateral direct defined between first and second ends 30 and 32 of end plates 14 is relative to support plates 16 and slats 22, and is not a limiting orientation of system 10.

End plates 14 may be generally planar and may be constructed out of any suitable material including steel, stainless steel, or the like. Although depicted here and discussed herein as generally rectangular, end plates 14 (and grating system 10) may have any suitable profile and/or shape as dictated by the installation parameters, as discussed further below.

Support plates 16 may be defined as longitudinal in that they may extend parallel to slats 22 and perpendicularly to end plates 14 but are not to be understood as a limiting factor in the orientation of grating system 10. Support plates 16 may then have a first side 38 separated from a second side 40 and defining the thickness of support plates 16 therebetween. Support plates 16 may further include a first end 42 spaced apart from a second end 44 and defining a longitudinal direction therebetween, and a top edge 46 spaced apart from a bottom edge 48 and defining the vertical direction between. Support plates 16 may further include at least one vertical through-opening, or slot, 50 defined therein for receiving toothed cross members 18 and cross member lock bars 20 therethrough, as discussed further below. Slots may have a top edge oriented towards the top edge 46 of support plates 16 and may further define the uppermost limit of slots 50. Slots may further have a bottom edge oriented towards the bottom edge 48 of support plates 16 and may further define the lowermost limit slots 50. Support plates 16 may further include one or more apertures 52 operable to receive slat lock bar(s) 24 therein, as discussed further below.

As with the end plates 14, support plates 16 may be generally planar and may be constructed of any suitable material including steel or other suitable metals, as dictated by the desired implementation.

Cross members 18 may have a first side 54 spaced apart from a second side 56 defining the thickness thereof. Cross members 18 may further include a first end 58 spaced apart from a second end 60 and defining a transverse direction therebetween, and a top edge 62 spaced vertically apart from a bottom edge 64. As with end plates 14, cross members 18 may be defined as lateral in that they extend perpendicularly to support plates 16 and slats 22.

Figure 3:
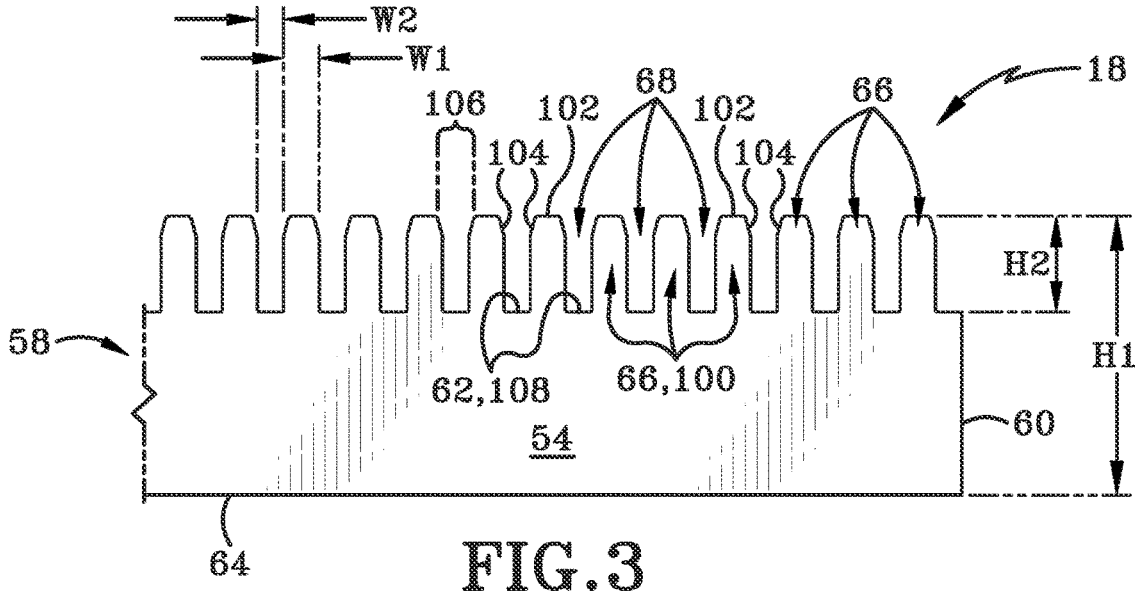
FIG. 3 is a side elevation view of a cross member of a grating system according to one aspect of the present disclosure.

Cross members 18 may be considered toothed cross members 18 in that they may include a plurality of teeth 66 separated by a plurality of cavities 68. According to one aspect, teeth 66 and cavities 68 may generally form a finger joint for interaction with slats 22 as discussed further below. Teeth 66 and cavities 68 may generally extend vertically upwards from top edge 62 of cross members 18 and may alternate along the lateral length thereof. As best seen in FIG. 3, and as discussed further below, teeth 66 may further include a body 100 having a tip 102 and a pair of tapered edges 104 which may provide an opening 106 into cavities 68. Cavities 68 may further include a base 108, which may be or substantially coincide with top edge 62 of toothed cross members 18.

As with the other components discussed herein, cross members 18 may be generally planar and may be similarly constructed of any suitable material including steel or other suitable metals, as dictated by the desired implementation.

Cross member lock bars 20 may have a first side 70 spaced apart from a second side 72 defining the thickness thereof, a first end 74 spaced laterally apart from a second end 76, and a top edge 78 spaced vertically apart from a bottom edge 80. Cross member lock bars 20 may have substantially the same length and thickness as cross members 18 to allow interaction therewith within slots 50 to hold cross members in position within slots 50, as discussed further below.

As with the other components discussed herein, cross member lock bars 20 may be generally planar and may be similarly constructed of any suitable material including steel or other suitable metals, as dictated by the desired implementation.

Slats 22 may have a first side 82 spaced apart from a second side 84 defining the thickness thereof, a first end 86 spaced longitudinally apart from a second end 88, and a top edge 90 spaced vertically apart from a bottom edge 92. Slats 22 may further include one or more apertures 94, which may align with apertures 52 in support plates 16 to accept one or more slat lock bars 24 therein, as discussed further below. As previously mentioned herein, slats 22 may be defined as longitudinal in that they may extend perpendicularly from end plates 14 but the longitudinal orientation of slats 22 is not to be understood as a limitation as to the orientation of grating system 10 but instead as a position relative to the other components thereof.

As with the other components discussed herein, slats 22 may be generally planar and may similarly be constructed of any suitable material including metal such as steel, or the like, as dictated by the desired implementation.

Slat lock bars 24 may be generally cylindrical bars having a first end 96 spaced laterally apart from a second end 98. According to one aspect, slat lock bars 24 may be hollow with first and second ends 96, 98 being open ends thereof. According to another aspect, slat lock bars may be hollow with first and second ends 96, 98 closed and/or capped at the ends of slat lock bars 24. According to yet another aspect, slat lock bars 24 may be solid or substantially solid. Slat lock bars 24 may be formed of any suitable material and be compressible, as discussed further below.

With reference to FIGS. 3-6, the sizing and relationship of the individual components of grating system 10 will now be discussed in more detail.

The slots 50, apertures 52, and apertures 94 may be sized according to the relative sizes of cross members 18, cross member lock bars 20, and slat lock bars 24, as discussed further below. As it relates to other relative sizing, the key components of grating system 10, including the teeth 66 and cavities 68 on cross members 18, may best be understood with reference to the relative dimensions of the components and the relationships therebetween. In particular, the lateral width and longitudinal length of grating system 10 may be defined by the specific installation parameters and may vary accordingly. For example, where the grating system 10 is employed on a sidewalk or on the side of a roadway, system 10 may be configured as a general square with the lateral width and longitudinal length being relatively equal. In other installations, grating system may be rectangular, or may have any suitable shape or dimension, as necessary. Accordingly, the references to the dimensions of grating system 10 components will be understood to be relative to facilitate assembly thereof and to further provide of proper interaction between components. For example, where a component is indicated to have a specific height relative to another component, the physical measurement of that height is not limited but instead the individual components are understood to maintain the relative height comparisons, regardless of physical size.

Accordingly, with reference to FIG. 3, teeth 66 may have a first width W1 which may substantially define the space or gap between slats 22 when grating system 10 is fully assembled. Cavities 68 may have a second width W2 which may substantially define the thickness of slats 22. This second width W2 may provide for a snug engagement of slats 22 within cavities 68, as discussed further herein, while the first width W1 may provide and maintain uniform spacing between adjacent slats 22.

With continued reference to FIG. 3, cross members 18, including teeth 66, may have an overall first height H1 while teeth 66 themselves may have a second height H2. The first height H1 may be defined as the vertical height from tip 102 of teeth 66 to bottom edge 64 of toothed cross members 18 while the second height H2 may extend from tip 102 of teeth 66 to base 108 of cavities 68 (which coincides with top edge 62 of cross members 18).

Figure 4:
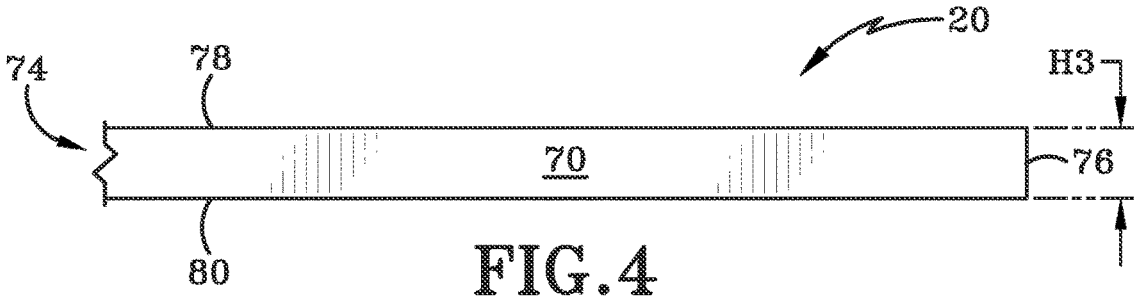
FIG. 4 is a side elevation view of a cross member lock bar of a grating system according to one aspect of the present disclosure.

With reference to FIG. 4, cross member lock bars 20 may have a third height H3 defined from the top edge 78 to the bottom edge 80 thereof.

Figure 5:
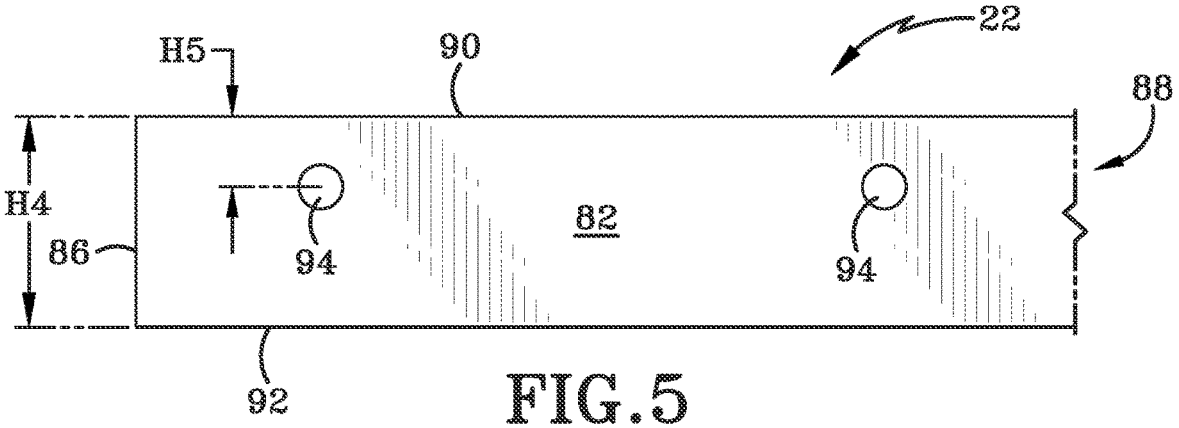
FIG. 5 is a side elevation view of a slat of a grating system according to one aspect of the present disclosure.

With reference to FIG. 5, slats 22 may have an overall height H4 defined from the top edge 90 to the bottom edge 92 thereof. Slats 22 may also include height H5, which may represent the distance between the top edge 90 and a center point in apertures 94 defined through slats 22.

Figure 6:
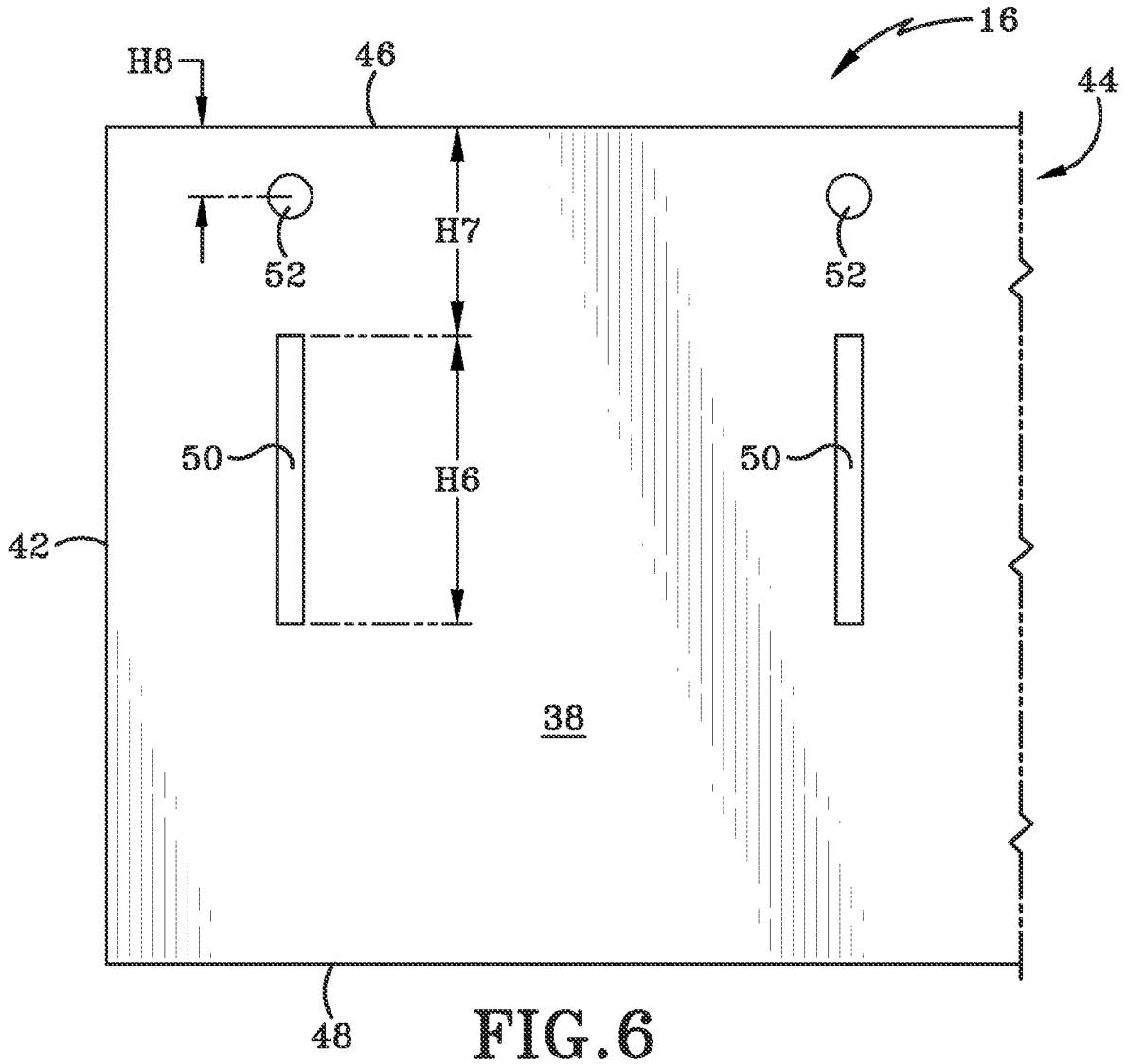
FIG. 6 is a side elevation view of a support plate of a grating system according to one aspect of the present disclosure.

With reference to FIG. 6, support plates 16, or more particularly, slots 50 of support plates 16 may have a sixth height H6 defined from the top edge to the bottom edge of slots 50. Support plates 16 may further include a seventh height H7 defined from the top edge of slots 50 to the top edge 34 of support plates 16 and an eighth height H8 defined from the top edge 34 of support plates 16 to a center line of apertures 52 defined through support plates 16.

Each of these heights H1 through H8 may determine relative relationships between specific components of grating system 10, which will now be discussed. Specifically, height H6 of slots 50 may be slightly larger than overall height H1 of cross members 18 to facilitate slidable engagement therewith. Height H6 however, may be less than the sum of heights H1 and H3 such that cross members 18 may be held within slots 50 when both cross members 18 and cross member lock bars 20 are inserted therein, as discussed below.

Height H4 and height H7 may be substantially identical such that top edge 90 of slats 22, top edge 34 of end plates 14, and top edge 46 of support plates 16 may all be substantially planar when grating system 10 is fully assembled. Similarly, height H5 and height H8 may be substantially identical to properly align a center point of apertures 52 and apertures 94 for lateral insertion of slat lock bars 24 therethrough, as discussed below.

Having thus described the elements and components of grating system 10, the assembly and configuration thereof will now be discussed.

With reference to FIGS. 2 and 7A-11, and as mentioned previously herein, grating system 10 may be sized according to the desired implementation and may have an indiscriminant length and width. Specifically, end plates 14 may have any transverse length between first end 30 and second end 32 as dictated by the desired implementation. Similarly support plates 16, cross members 18, and slats 22 may have any length between the ends thereof. Grating system 10 may further have any varying number of support plates 16, cross members 18, lock bars 20, slats 22, and/or slat lock bars 24, as desired and/or necessary based on the specific size and installation parameters for a particular implementation thereof. According to one example, as shown in the figures, there may be approximately five slats 22 between each support plate 16. Therefore, in an example with three support plates 16 (one at each end and one central support plate 16), there will be two end plates 14, three support plates 16, and ten slats 22. Similarly the cross members 18, cross member lock bars 20, and slat lock bars 24 may vary in number depending upon the longitudinal length of grating system 10.

As described with the example above, and in most installations, grating system 10 is contemplated to have two end plates 14 with one support plate 16 at either lateral end thereof. Grating system 10 may have any shape, as discussed herein; however, grating system 10 is contemplated to most commonly be configured to form a generally square or rectangular shape. Accordingly, and solely for purposes of clarity and simplicity in this disclosure, grating system 10 will be discussed as a square configuration having two end plates 14 and a series of support plates 16 evenly spaced and disposed therein, including one support plate 16 at each lateral end of the end plates 14. Further, grating system 10 will be described with a plurality of cross members 18, cross member lock bars 20, slats 22, and slat lock bars 24.

Thus, two end plates 14 may first be arranged with a first support plate 16 placed at the first end 30 of end plates 14 and a second support plate 16 placed at the second end 32 of end plates 14. These first and second support plates 16 may be fixed to end plates 14 through any suitable means, including, but not limited to, welding the first and second ends 42 and 44 of support plates 16 to the sides (either first side 26 or second side 28, depending on placement) of end plates 14. Any additional support plates 16 may be evenly spaced between the first and second support plates 16 and attached to end plates 14 to form a general framework of grating system 10, if desired.

Figure 7A:
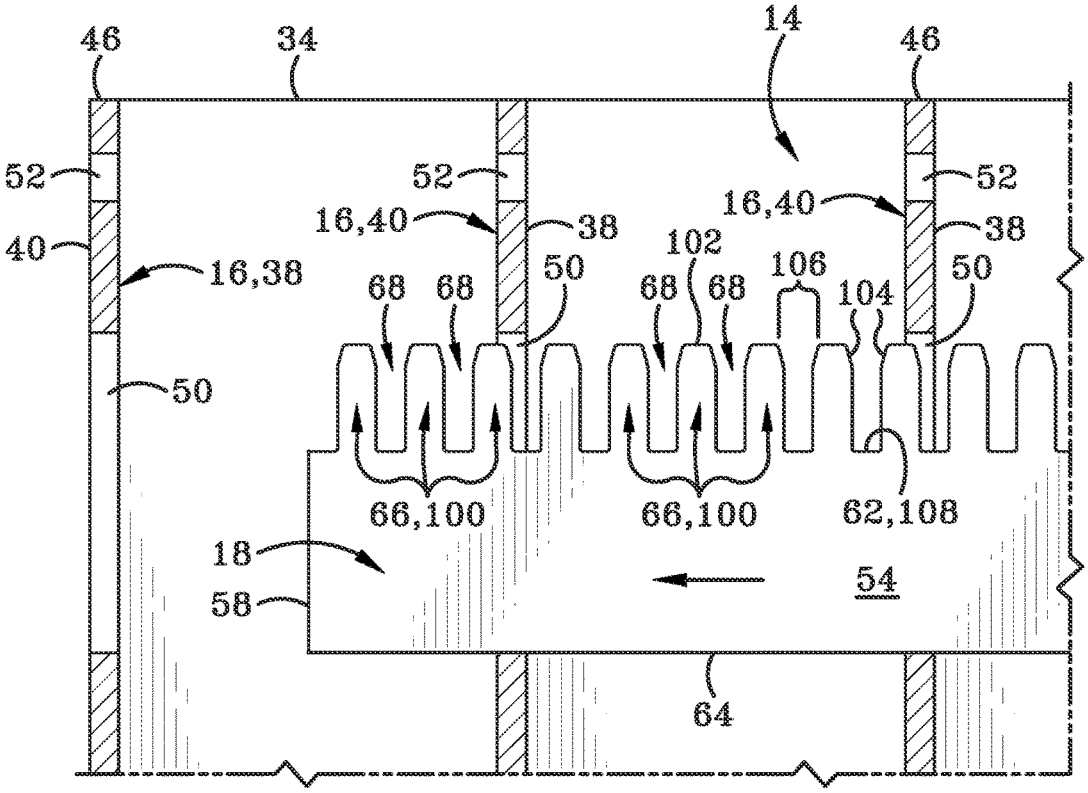
FIG. 7A is a side elevation operational view of a grating system according to one aspect of the present disclosure.
Figure 7B:
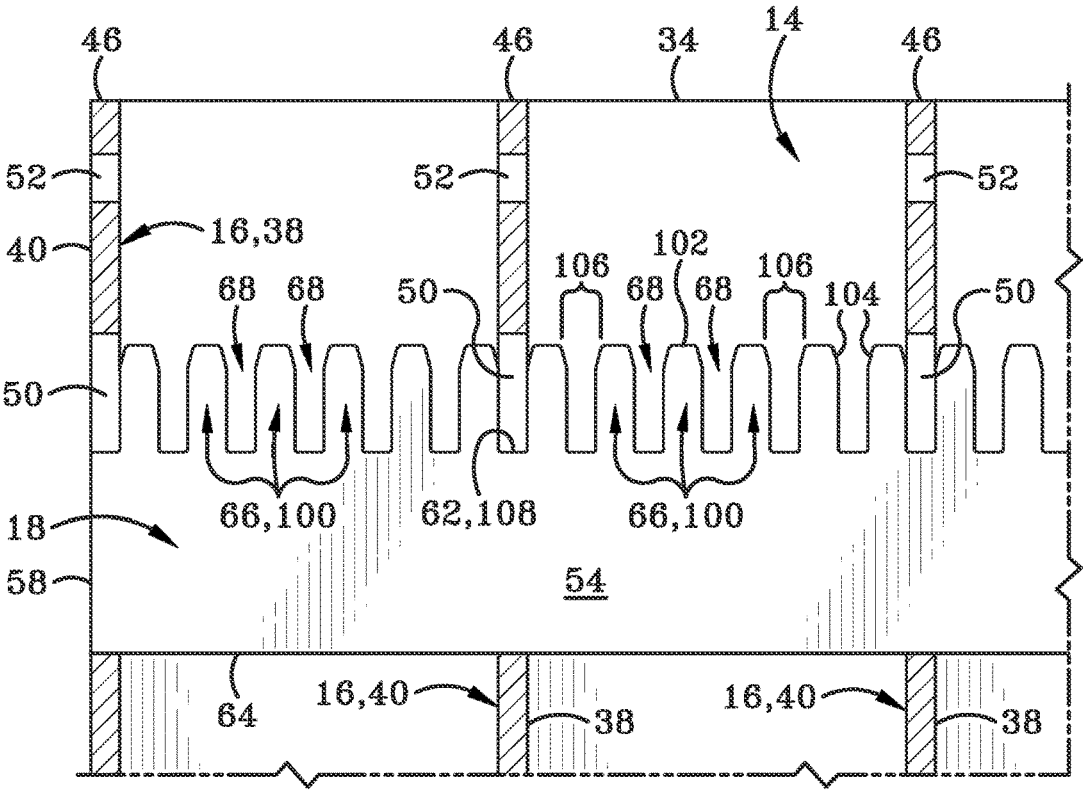
FIG. 7B is a side elevation operational view of a grating system according to one aspect of the present disclosure.
Figure 7C:
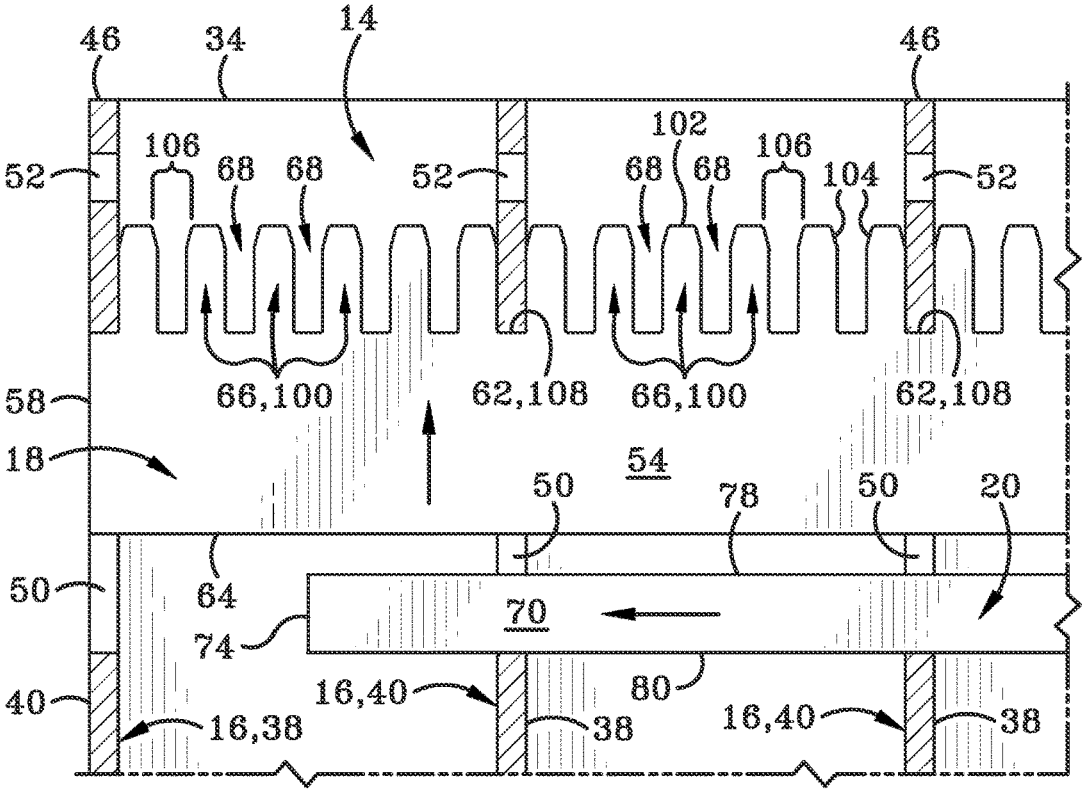
FIG. 7C is a side elevation operational view of a grating system according to one aspect of the present disclosure.

Next, for each slot 50 defined in the support plates 16, a cross member may first be slidably inserted therein, as best seen in FIG. 7A, until the first and second ends 58, 60 thereof align with the first and second support plates 16, as seen in FIG. 7B. Cross members 18 may be inserted into slots 50 from either direction, but will be described as being inserted right to left, as indicated by the arrows in FIG. 7A. Having inserted toothed cross member 18 into slots 50, cross members 18 may be raised into position wherein the support plates 16 may fit into cavities 68 such that the top edge of slots 50 may interact with base 108 of cavities 68, as best seen in FIG. 7C. Next, cross member lock bars 20 may be slidably inserted into the space within slots 50 and then raised into position as seen in FIG. 7C and FIG. 7D.

Figure 7D:
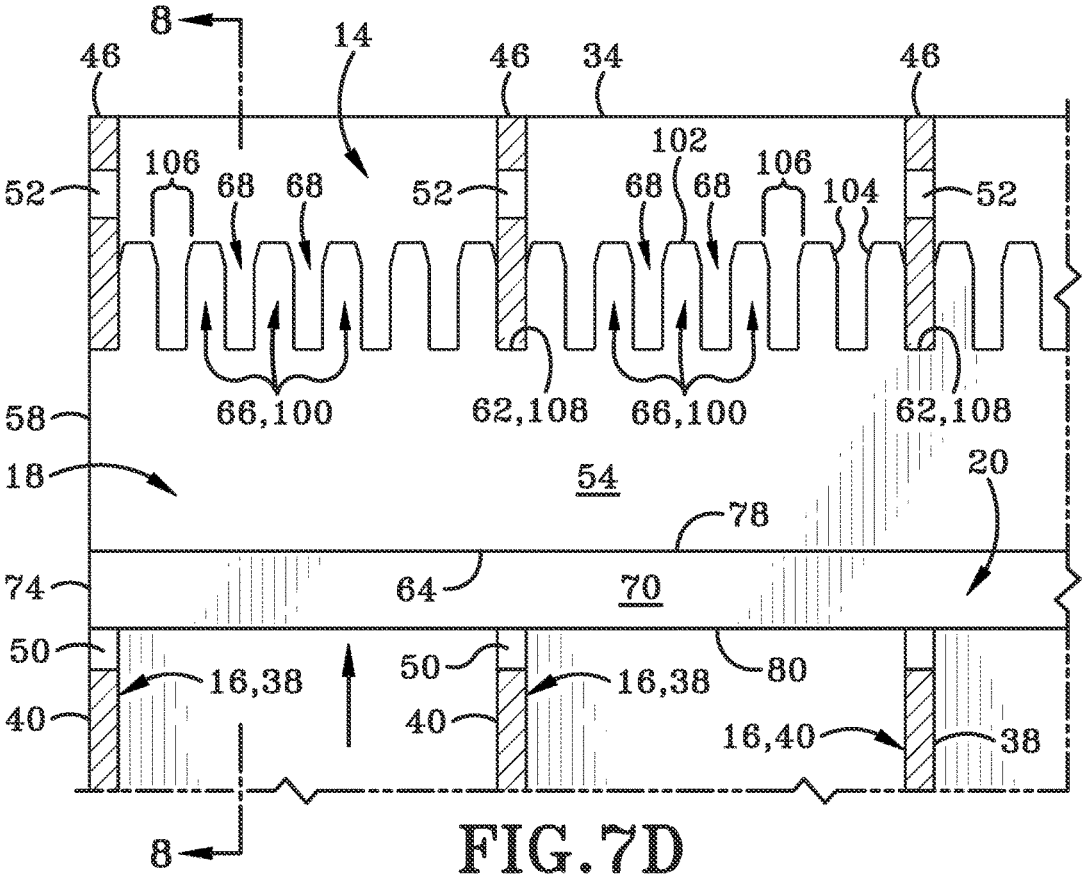
FIG. 7D is a side elevation operational view of a grating system according to one aspect of the present disclosure.

Although shown and described herein with components being "raised" into place in the direction of the arrows in FIGS. 7C and 7D, it will be readily understood that assembly may be more easily accomplished with the grating system 10 in an upside down arrangement, which may then be oriented properly before installation into supporting structure 12.

Figure 8:
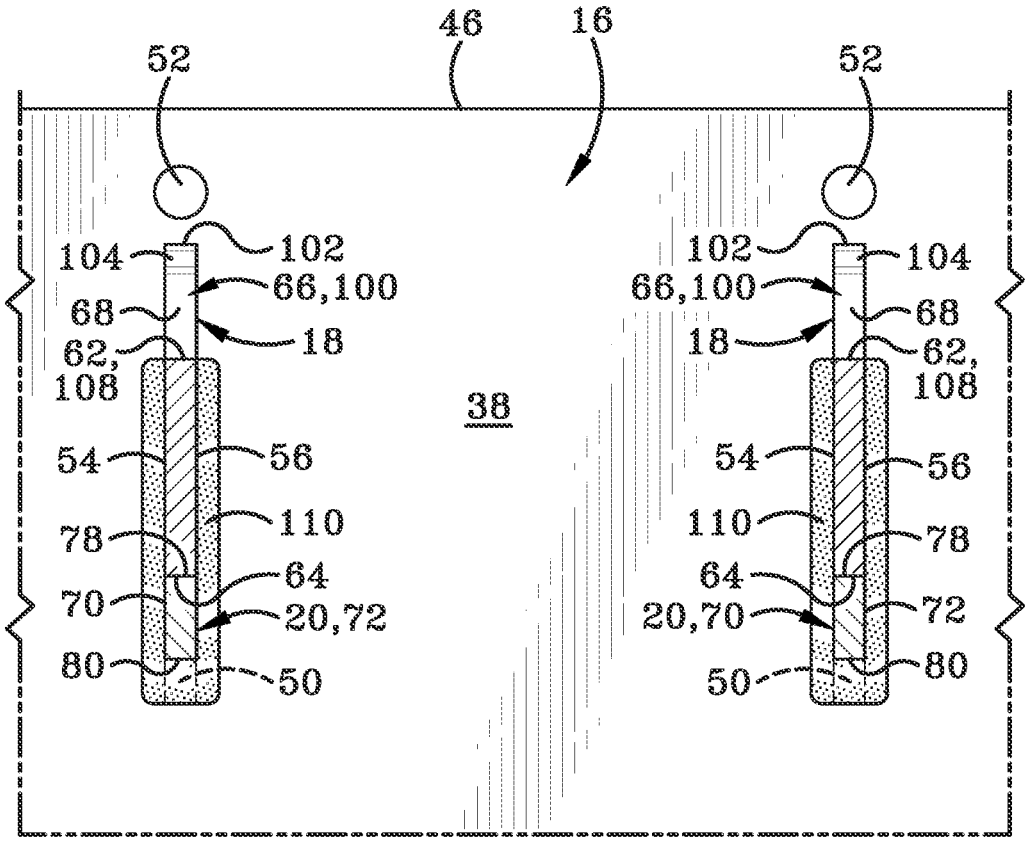
FIG. 8 is a side elevation operational view of a grating system according to one aspect of the present disclosure.

With reference to FIG. 8, once cross members 18 and cross member block bars 20 are fully inserted in slots 50, each instance where cross members 18 and cross member lock bars 20 encounter a support plate 16, including the first and second support plates 16, cross members 18 and cross member lock bars 20 may be welded to support plates 16. One example of these welds is best seen in FIG. 8 at reference 110. According to this example, welds 110 may be partial perimeter welds that substantially surround the sides 54 and 56 cross members 18 and the sides 70 and 72 and bottom 80 of cross member lock bars 20 on both sides 38 and 40 of the support plates 16. As further seen in FIG. 9A, welds 110 may further fill any remaining gap within slots 50 not taken up or otherwise occupied by cross members 18 and cross member lock bars 20. These welds 110 are contemplated to not extend above or on top edge 62 of cross members 18 as to prevent the welds 110 from interfering with the assembly of grating system 10, discussed herein. According to another aspect, welds 110 may be reduced partial perimeter welds. For example, welds 110 may only be on one side, e.g. 54 or 56, of cross members 18 and one side 70 or 72 of cross member lock bars 20, as well as under the bottom 80 of cross member lock bars 20. In this example, welds 110 may be substantially "L" shaped with the bottom of the "L" extending under bottom 80 of cross member lock bars 80 to secure the cross members 18 and cross member lock bars 20 in position. According to another aspect, welds 110 may be placed in any suitable spot or with any suitable configuration to secure cross members 18 and cross member lock bars 20 in position within slots 50.

Figure 9A:
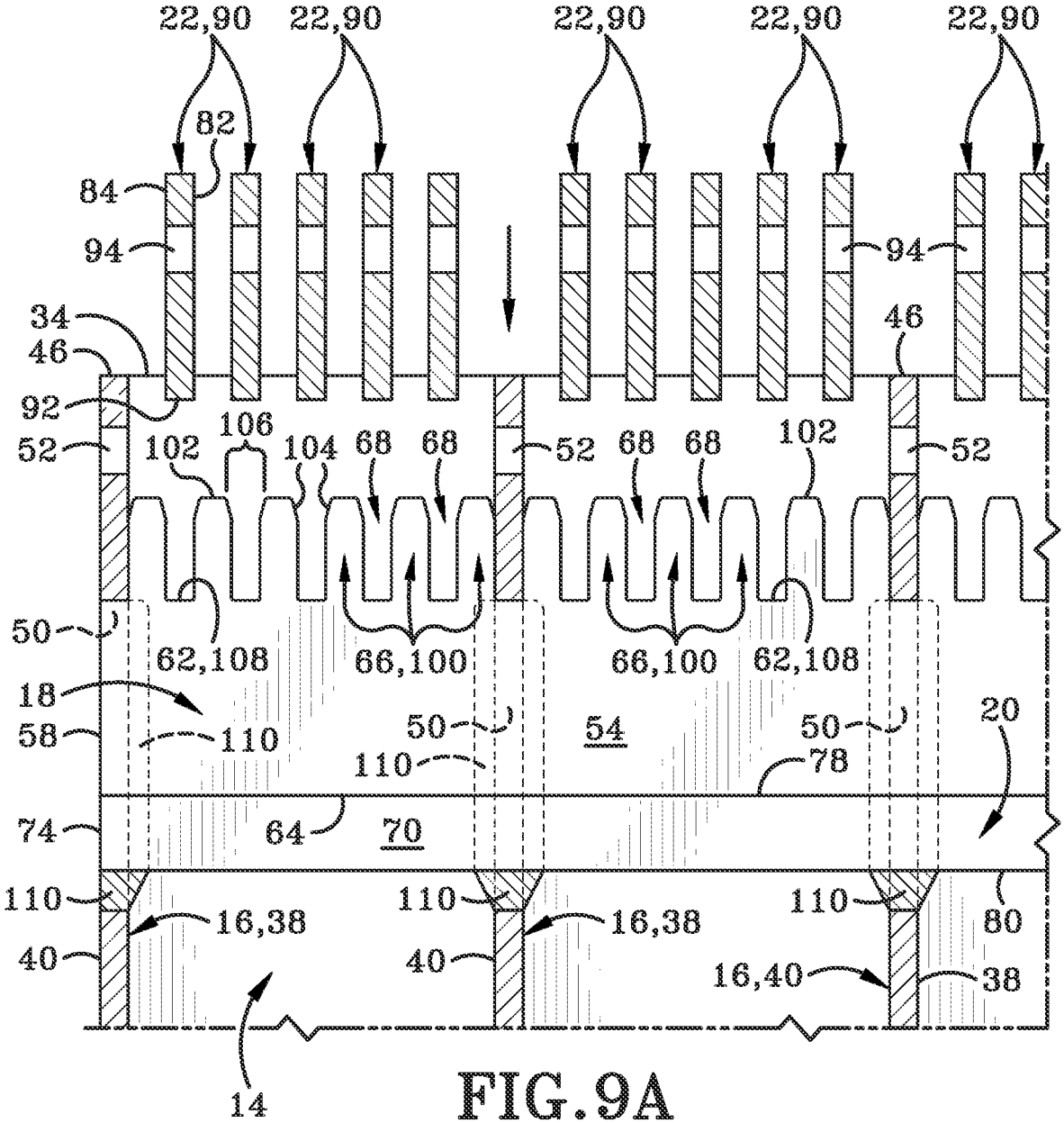
FIG. 9A is a partial cross-section side elevation operational view of a grating system according to one aspect of the present disclosure.
Figure 9B:
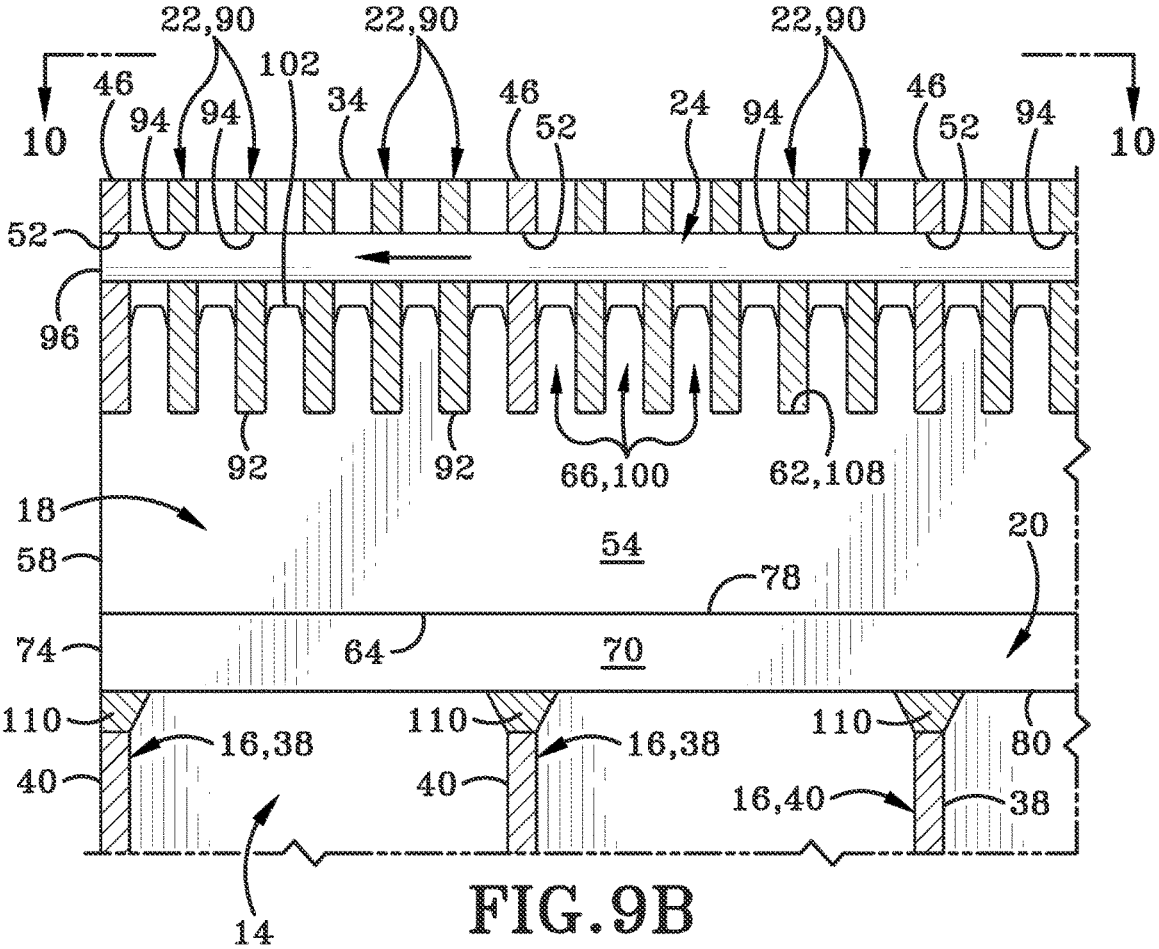
FIG. 9B is a partial cross-section side elevation operational view of a grating system according to one aspect of the present disclosure.

With reference to FIG. 9A and FIG. 9B, with cross members 18 and cross member lock bars 20 inserted and secured into slots 50 by welds 110, slats 22 may be inserted into each cavity 68 between teeth 66 of cross members 18. The thickness of slats 22 may provide a snug fit within cavities 68 and the height H4 thereof may provide that slats 22 may sit with the bottom edge 92 thereof flush against base 108 of cavities 68 while the top edge 90 may be substantially planar with the top edges 34 and 46 of end plates 14 and support plates 16, respectively. Similarly, the relative heights H5 and H8 may allow for apertures 94 in slats 92 to align with apertures 52 in support plates 16 to allow slidable insertion of slat lock bars 24 therein, as illustrated in FIG. 9B and discussed below.

Figure 10:
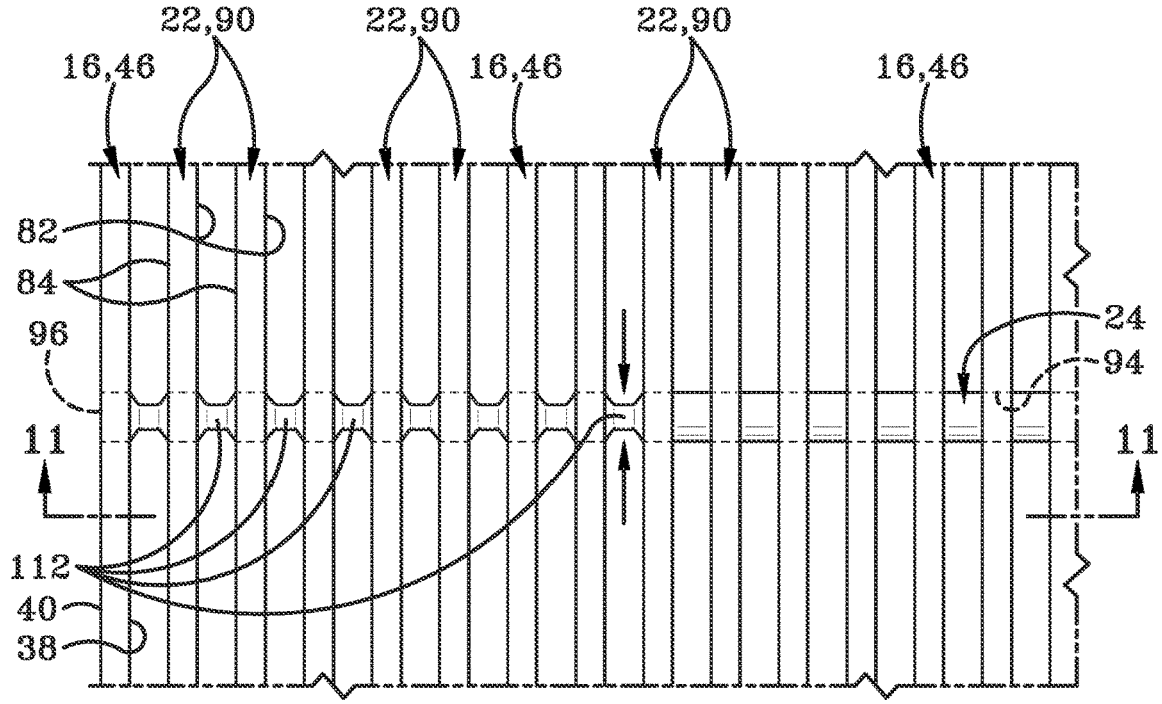
FIG. 10 is a top view of the grating system looking in the direction of the line 10-10 from FIG. 9B according to one aspect of the present disclosure.
Figure 11:
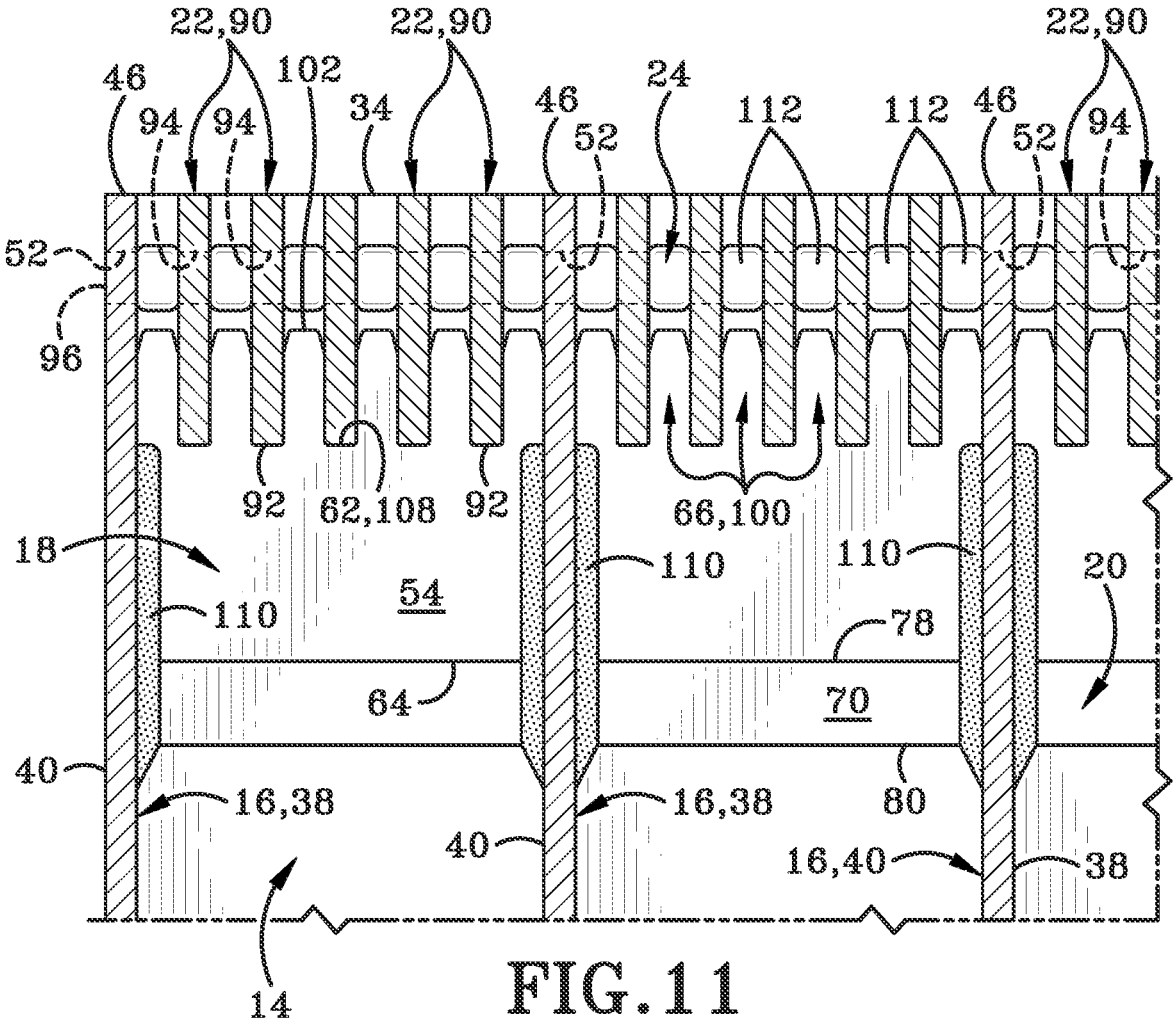
FIG. 11 is a cross-section side elevation view of the grating system looking in the direction of line 11-11 from FIG. 10 according to one aspect of the present disclosure.

With reference to FIGS. 10 and 11, once all the slats 22 have been placed and slat lock bars 24 have been inserted through apertures 52 and 94, the slat lock bars 24 may be compressed between each slat 22 (as indicated by the arrows in FIG. 10), further forming a series of compressed sections 112. These compressed sections 112 may cause slat lock bars 24 to narrow in thickness as viewed from above (FIG. 10) while simultaneously causing them to expand in height as viewed from the side (FIG. 11) to both lock slat lock bars 24 in position within apertures 52, 94 while simultaneously securing slats 22 in relative configuration to maintain the desired spacing between slats 22 and to prevent lateral movement thereof during use. Thus the relationship between slats 22, teeth 66, cavities 68, and slat lock bars 24, including compressed sections 112, may securely lock grating system 10 into its final configuration where it may then be installed into a supporting structure 12. Further, the inclusion and configuration of teeth 66, cavities 68, and slat lock bars 24, including compressed sections 112, may facilitate a longer lifespan and more durable use of grating system 10, even when exposed to heavy and repeated traffic, including vehicle traffic.

According to one aspect, each component of grating system 10 may be welded or otherwise affixed together through any suitable means, including, but not limited to mechanical fasteners, epoxies, or the like. One notable exception may be to exclude mechanical connections such as welds or mechanical fasteners on the top edges 34, 46, and 90 of the end plates 14, support plates 16 and slats 22 to prevent any physical structure extending above the physical plane established by these edges when grating system 10 is fully assembled. This may prevent damage to grating assembly 10 during use. For example, a mechanical fastener extending above this plane may present a tripping hazard, or where used with vehicles, a tire damage hazard, or a catch point for snow plows or the like.

The grating system 10, as described herein, may provide distinct advantages in that it may be installed and used in areas with heavy traffic, including heavy weight vehicles, while maintaining its structural form with an increased lifespan. Further, the specific configuration, namely the inclusion of finger joints (i.e. teeth 66 and cavities 68) and compressed portions 112 of slat lock bars 24 may support the components of grating system 10 to prevent damage caused by debris that may enter into the system 10.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments. Specifically, although the assembly of grating system 10 is described herein with a particular sequence, it will be understood that the elements and components of grating system 10 may be assembled in any suitable order. According to one non-limiting example, the slats 22 and slat lock bars 24 may be assembled with support plates 16 and the slat lock bars 24 may be compressed prior to assembling the remaining components.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A grating system comprising:

a pair of end plates spaced longitudinally;

a first support plate operably connected to the pair of end plates and oriented perpendicularly thereto;

a second support plate spaced laterally from the first end plate, the second support plate operably connected to the pair of end plates and oriented perpendicularly thereto;

at least one cross member having a plurality of alternating teeth and cavities on a top edge thereof, the at least one cross member extending between the first and second support plates;

at least one cross member lock bar corresponding to the at least one cross member;

a plurality of slats extending between the pair of end plates, with each slat of the plurality of slats contained within a cavity of the plurality of cavities; and at least one slat lock bar operable to secure the plurality of slats in the plurality of cavities.

2. The grating system of claim 1 further comprising:

at least one additional support plate operably connected to the pair of end plates laterally between the first and second support plates and oriented perpendicularly thereto; and at least one vertical slot defined through each of the first, second, and at least one additional support plates operable to slidably engage the at least one cross member and the at least one cross member lock bar therethrough.

3. The grating system of claim 2 wherein the at least one cross member and the at least one cross member lock bar are welded to the at least one vertical slot defined in each of the first, second, and at least one additional support plates.

4. The grating system of claim 2 each of the first, second, and at least one additional support plates further comprise:

at least one aperture defined therethrough operable to slidably engage the at least one slat lock bar therethrough.

5. The grating system of claim 4 wherein each slat of the plurality of slats further comprise:

at least one aperture defined therethrough corresponding to and aligned with at least one aperture defined through each of the first, second, and the at least one additional support plates.

6. The grating system of claim 5 wherein the slat lock bar is operable to secure the plurality of slats by slidable engagement with the at least one aperture defined through each slat of the plurality of slats and the at least one aperture defined through the first, second, and the at least one additional support plates.

7. The grating system of claim 6 wherein the at least one slat lock bar further comprises:

a plurality of compressed portions with at least one compressed portion between every two adjacent slats of the plurality of slats.

8. The grating system of claim 5 wherein the plurality of compressed portions of the at least one slat lock bar is operable to secure the slat lock bar in position within the slats and is further operable to prevent lateral movement of the plurality of slats.

9. The grating system of claim 1 wherein a top edge of the end plates, a top edge of each of the first and second support plates, and a top edge of each of the plurality of slats further define a plane.

10. The grating system of claim 8 wherein the plane defined by the top edges of the end plates, each of the first, second, and at least one additional support plates, and each of the plurality of slats coincides with a surface of a supporting structure to further define a flat surface.

11. The grating system of claim 1 wherein the ends plates and the first and second support plates further define a square.

12. The grating system of claim 2 wherein the at least one additional support plate is evenly spaced between the first and second support plates.

13. The grating system of claim 12 wherein the plurality of slats are evenly spaced between the first, second, and the at least one additional support plates.

14. The grating system of claim 13 further comprising:

five slats of the plurality of slats evenly spaced between the first support plate and the at least one additional support plate; and five slats of the plurality of slats evenly spaced between the second support plate and the at least one additional support plate.

15. A method of assembling a grating system comprising:

securing a first support plate to a first end of a pair of end plates;

securing a second support plate to a second end of the pair of end plates;

sliding a cross member into a first position wherein the cross member extends through a slot defined in the first support plate and into a slot defined in the second support plate;

raising the cross member into a second position wherein a top edge thereof abuts a top edge of the slots defined in each of the first and second, support plates;

sliding a cross member lock bar through the slots defined in each of the first and second support plates;

raising the cross member lock bar to abut a bottom edge of the cross member;

fixing the cross member and cross member lock bar in the second position;

inserting a plurality of longitudinally extending slats into a plurality of cavities defined between a plurality of teeth extending from the top edge of the cross member; and securing the plurality of slats in position with a slat lock bar.

16. The method of claim 15 wherein securing the plurality of slats with the slat lock bar further comprises:

inserting the slat lock bar through at least one aperture defined through each slat of the plurality of slats and at least one aperture defined through each of the first and second support plates.

17. The method of claim 16 further comprising:

compressing a portion of the slat lock bar between each adjacent pair of slats of the plurality of slats.

18. The method of claim 15 wherein fixing the cross member and cross member lock bar further comprises:

welding the cross member and the cross member lock bar to each of the first, second, and at least one additional support plate.

19. A grating system comprising:

a pair of end plates spaced longitudinally;

a first support plate having at least one vertical slot defined therethrough, the first support plate operably connected to the pair of end plates and oriented perpendicularly thereto;

a second support plate having at least one vertical slot defined therethrough, the second support plate spaced laterally from the first end plate, the second support plate operably connected to the pair of end plates and oriented perpendicularly thereto;

at least one additional support plate having at least one vertical slot defined therethrough, the at least one additional support plate operably connected to the pair of end plates laterally between the first and second support plates and oriented perpendicularly thereto;

at least one cross member having a plurality of alternating teeth and cavities on a top edge thereof, the at least one cross member extending between the first and second support plates and through the at least one vertical slot defined through each of the first, second, and at least one additional support plates;

at least one cross member lock bar corresponding to the at least one cross member, the at least one cross bar extending between the first and second support plates and through the at least one vertical slot defined through each of the first, second, and at least one additional support plates;

a plurality of slats having at least one aperture defined through each slat corresponding to and aligned with at least one aperture defined through each of the first, second, and at least one additional support plates, the plurality of slats extending between the pair of end plates, with each slat of the plurality of slats contained within a cavity of the plurality of cavities; and at least one slat lock bar slidably engaged with the at least one aperture defined through each slat of the plurality of slats and the at least one aperture defined through the first, second, and the at least one additional support plates, the at least one slat lock bar operable to secure the plurality of slats in the plurality of cavities.

20. The grating system of claim 19 further comprising:

five slats of the plurality of slats evenly spaced between the first support plate and the at least one additional support plate; and five slats of the plurality of slats evenly spaced between the second support plate and the at least one additional support plate.

* * * * *